US005479179A

United States Patent [19]

Hirotsu et al.

[11] Patent Number: 5,479,179

[45] **Date of Patent: * Dec. 26, 1995**

[54] STRUCTURE FOR CONNECTING WINDOW GLASS ANTENNA WITH FEEDER

[75] Inventors: Tohru Hirotsu; Yoji Nagayama; Junichiro Ieiri, all of Matsusaka, Japan

[73] Assignee: Central Glass Company, Limited, Yamaguchi, Japan

[ * ] Notice: The portion of the term of this patent subsequent to Dec. 7, 2010, has been disclaimed.

[21] Appl. No.: 100,221

[22] Filed: Aug. 2, 1993

[30] Foreign Application Priority Data

Jul. 31, 1992 [JP] Japan ..... 4-205627

[51] Int. Cl.[6] ..... H01Q 1/32

[52] U.S. Cl. ..... 343/713; 343/906

[58] Field of Search ..... 343/713, 906; 439/98, 578, 585, 874, 63; 174/74 R; H01Q 1/320, 1/380

[56] References Cited

U.S. PATENT DOCUMENTS

| | | | |
|---|---|---|---|
| 1,970,022 | 8/1934 | Pietenpol et al. | 439/874 |
| 2,180,695 | 4/1987 | Sato | 343/713 |
| 4,222,056 | 9/1980 | Graeser, Jr. et al. | 343/906 X |
| 4,721,964 | 1/1988 | Sato et al. | 343/713 |
| 5,098,314 | 3/1992 | Castagna et al. | 439/874 X |
| 5,181,044 | 1/1993 | Matsumoto et al. | 343/713 X |
| 5,195,910 | 3/1993 | Enomoto et al. | 439/578 |
| 5,268,700 | 12/1993 | Hirotsu et al. | 343/906 X |

FOREIGN PATENT DOCUMENTS

| | | | |
|---|---|---|---|
| 51-16677 | 5/1976 | Japan | H01Q 1/32 |
| 4-5708 | 1/1992 | Japan | H01Q 1/32 |
| 4-116411 | 10/1992 | Japan | H01Q 1/32 |

*Primary Examiner*—Donald T. Hajec
*Assistant Examiner*—Tho G. Phan
*Attorney, Agent, or Firm*—Keck, Mahin & Cate

[57] ABSTRACT

An antenna attached to a window glass for transmitting and receiving ultrashort waves includes a primary antenna having a first feed point which is electrically connected therewith, a secondary antenna having a second feed point which is electrically connected therewith. A feeder is a coaxial cable having inner and outer conductors, an insulator disposed therebetween, and an outer cover covering the outer conductor. A first terminal which is electrically connected to the first feed point, a first holding portion for holding the inner conductor of the feeder so as to achieve an electrical connection between the first terminal and the inner conductor. A second terminal which is electrically connected to the second feed point has a second holding portion for holding the outer conductor of the feeder. The second holding portion has a through opening which is substantially rectangular or elliptical in shape for pouring thereinto a solder to achieve a soldering between the outer conductor and the holding portion. The through opening has a major side or a major axis, which has a length not shorter than 4 mm. Therefore, the solder can be poured into the through opening under the condition that the contact between the outer conductor and the holding portion is checked with the naked eye.

13 Claims, 3 Drawing Sheets

STRUCTURE FOR CONNECTING WINDOW GLASS ANTENNA WITH FEEDER

BACKGROUND OF THE INVENTION

1. Field of the Invention

The present invention relates to a structure for connecting a window glass antenna with a feeder, and more particularly to a structure for respectively connecting primary and secondary antennas with an inner conductor of a coaxial cable serving as the feeder and with an outer conductor of the same.

2. Description of the Prior Art

There are some proposals of providing an antenna for transmission and reception of ultrashort waves on an automobile or a building window glass. For example, U.S. Pat. No. 4,721,964 discloses a vehicular window glass antenna system which has one feeding point connected to an inner conductor of a coaxial cable serving as a feeder. An outer conductor of the coaxial cable is grounded, through a lead such as a polyvinyl chloride wire, to a part of a vehicular body serving as a grounded conductor, the part being located near the feeding point. However, this type of antenna has the following drawbacks.

The outer conductor is not directly connected to the part of the vehicular body, but to the same through the lead. Therefore, the assembly work becomes complicated due to the installation of the lead. Furthermore, due to the provision of the lead, there is provided a certain inevitable transmission loss, thereby lowering reception gain.

JP-B (Utility Model) 51-16677 discloses a vehicular window glass antenna which is installed on a laminated glass. The laminated glass has two overlapped glass plates interposing therebetween an interlayer and an antenna. One of the glass plates has a through opening, for fully receiving therein a first terminal connected to the antenna. The first terminal is detachably connectable with a second terminal of a feeder. However, this type of antenna has the following drawback.

For installing the first terminal, it is necessary to drill the glass plate. This makes the assembly complicated and lowers strength of the laminated glass. Furthermore, this type of antenna can not be installed on a single glass plate.

JP-A (Utility Model) 4-5708 discloses a structure for connecting primary and secondary antennas with an inner conductor of a coaxial cable and with an outer conductor of the same through first and second terminals, respectively. The first terminal has a bent portion defining a space for tightly holding therein the inner conductor. The second terminal has a supporting portion which is semicylindrical in shape, and on which the outer conductor is supported. However, this connecting structure has the following drawbacks.

Because an upper half portion of an end portion of the outer conductor is exposed, upon soldering the outer conductor to the second terminal by a soldering iron, the outer conductor tends to be overheated by a direct abutment with the soldering iron. This overheat tends to damage an insulator disposed between the inner and outer conductors.

In view of the above-mentioned drawbacks, JP-A (Utility Model) 4-116411 discloses another structure for connecting primary and secondary antennas with an inner conductor of a coaxial cable and with an outer conductor of the same through first and second terminals, respectively. The second terminal has larger and smaller cylindrical portions. The smaller cylindrical portion has a through opening, and a certain amount of solder is adhered to the smaller cylindrical portion so as to fill up the through hole. In assembly, the coaxial cable is thrust into the larger and smaller cylindrical portions so as to hold an outer cover of the coaxial cable and the outer conductor of the same by the larger and smaller cylindrical portions, respectively. Then, a heated soldering iron is brought into abutment with the solder adhered to the smaller cylindrical portion so as to achieve soldering between the outer conductor and the smaller cylindrical portion. However, this structure has the following drawback.

The size of the through hole of the smaller cylindrical portion is not specified at all. Therefore, in case that its size is too small, it becomes difficult to check if a contact between the outer conductor and the small cylindrical portion is sufficiently achieved or not. If the soldering period becomes too long in this case, the outer cover and an insulator of the coaxial cable tend to be damaged. If the soldering period is too short, a contact between the outer conductor and the small cylindrical portion becomes poor.

SUMMARY OF THE INVENTION

It is therefore an object of the present invention to provide an improved structure for connecting primary and secondary antennas with a feeder, in which soldering between the outer conductor of the coaxial cable and a holding portion of a second terminal can be conducted under the condition that the contact between the outer conductor and the holding portion is checked with the naked eye.

According to the present invention, there is provided an antenna attached to a window glass for transmitting and receiving ultrashort waves, the antenna including:

a primary antenna having a first feed point which is electrically connected therewith:

a secondary antenna having a second feed point which is electrically connected therewith;

a feeder which is a coaxial cable having inner and outer conductors, an insulator disposed therebetween, and an outer cover covering the outer conductor said inner conductor being electrically connected with said first feed point; and a terminal which is electrically connected with said second feed point said terminal having a holding portion for holding the outer conductor of said feeder, said holding portion having a through opening which is elongate in shape for pouring thereinto a solder to achieve a soldering between said outer conductor and said holding portion, said through opening having a major side having a length not shorter than 4 mm.

DESCRIPTION OF THE PREFERRED EMBODIMENTS

Figure 1:
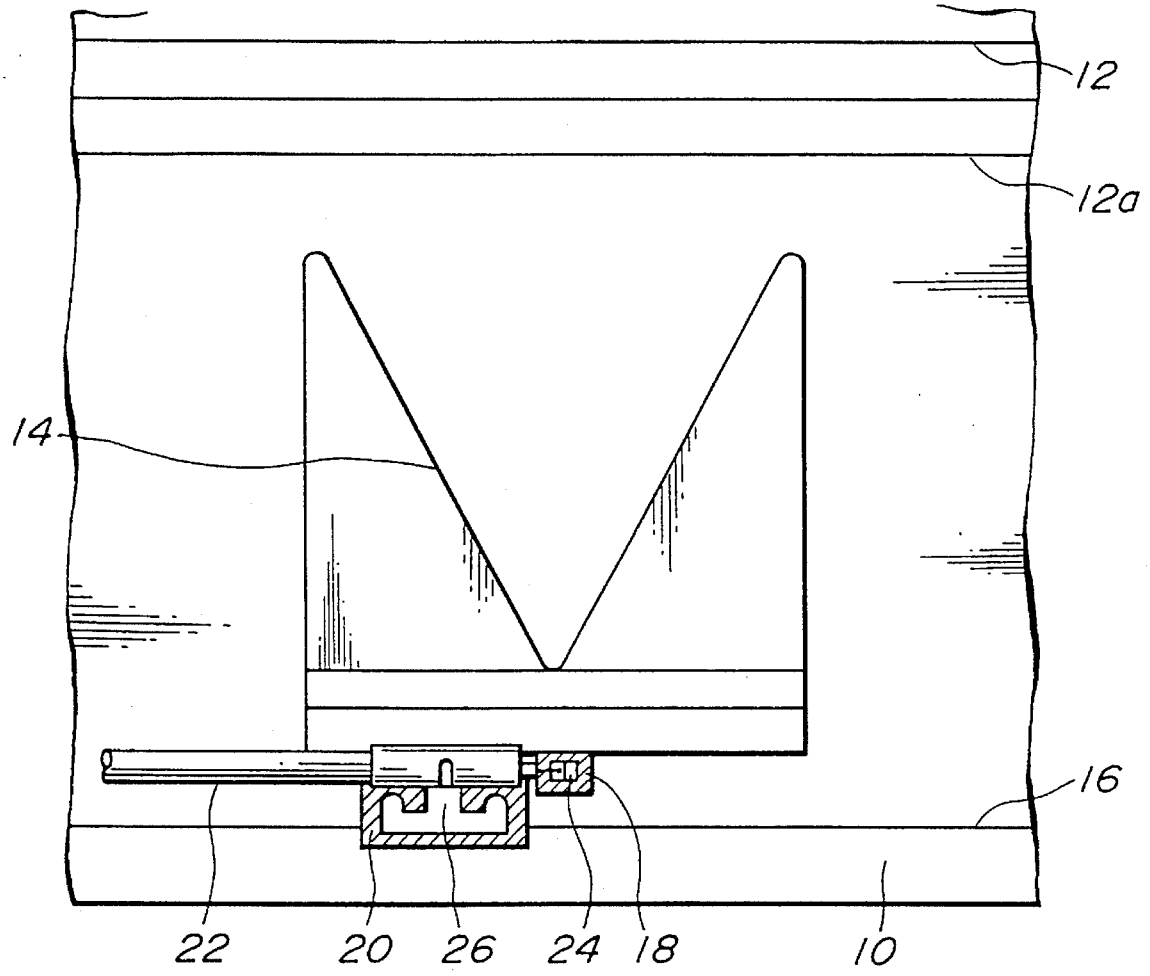
FIG. 1 is a partial plan view of an automobile rear window glass provided with primary and secondary antennas which are connected with a coaxial cable through a connecting structure according to a first embodiment of the present invention.
Figure 2:
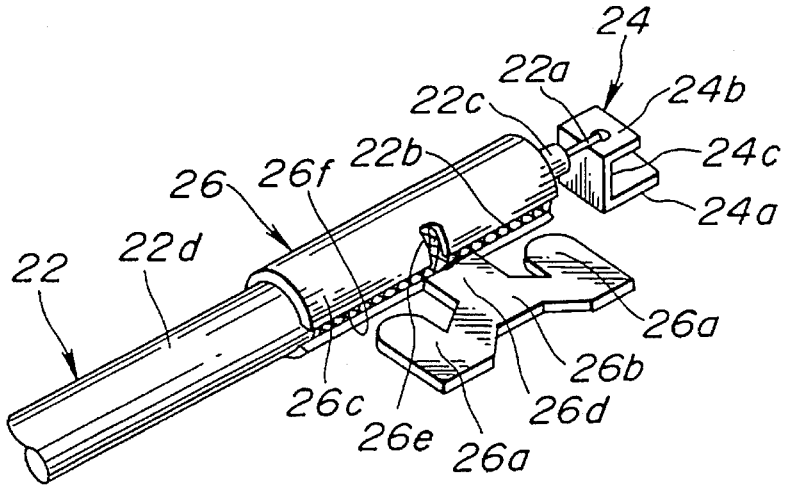
FIG. 2 is a perspective and enlarged view showing the connecting structure according to the first embodiment of the present invention.

With reference to FIGS. 1 and 2, a connecting structure according to a first embodiment of the present invention will be described in the following.

Designated by numeral 10 is an automobile rear window glass. However, if desired the present invention may be embodied in an automobile front or side window glass, or a building window glass, too. A single glass plate or a laminated glass is used as the window glass 10. An array of defogging heater strips 12 extends horizontally and is disposed on the inboard surface of the window glass 10 so as to leave an open space between the lower edge of the window glass 10 and the lowermost heater strip 12*a*.

Using the open space below the heater strips 12, an ungrounded antenna is disposed on the inboard surface of the window glass 10. Essentially the antenna is a combination of a primary antenna 14 and a secondary antenna 16. The primary antenna 14 is made up of a plurality of wire-like conductive strips and is connected to a first feed point 18. The secondary antenna 16 which extends horizontally is a single conductive strip having some width, and it is spaced from the primary antenna 14 and connected to a second feed point 20.

Usually the elements of the primary and secondary antennas 14 and 16 and the first and second feed points 18 and 20 as well as the heater strips 12 are formed by printing a conductive paste onto the glass surface and, after drying, baking the window glass 10 with the printed paste thereon.

A coaxial cable 22 is used to connect the antenna to a transmitter-receiver (not shown) installed in the automobile.

As is seen from FIG. 2 to 5, the coaxial cable 22 has an inner conductor (core) 22*a*, a tubular outer conductor 22*b*, an insulator 22*c* which is interposed between the inner and outer conductors 22*a* and 22*b*, and an outer cover 22*d* which covers the outer conductor 22*b*. The coaxial cable 22 has one end at which the inner and outer conductors 22*a* and 22*b* are exposed.

As is seen from FIGS. 1 and 2, first and second terminals 24 and 26 according to a first embodiment of the present invention are used to connect the primary and secondary antennas 14 and 16, through the first and second feeding points 18 and 20, with the inner and outer conductors 22*a* and 22*b* of the coaxial cable 24, respectively. The first and second terminals 24 and 26 are of metal plates made of, for example, an alloy which contains copper and is plated with tin or nickel.

As is seen from FIG. 2, the first terminal 24 comprises a base portion 24*a*, a supporting portion 24*b* which is arranged substantially parallel to the base portion 24*a*, and a connecting portion 24*c* for uniting the supporting portion 24*b* with the base portion 24*a*.

The second terminal 26 comprises two opposed base portions 26*a*, a first connecting portion 26*b* which connects the base portions 26*a* with each other, a hollow cylindrical portion 26*c*, and a second connecting portion 26*d* which connects the hollow cylindrical portion 26*c* with the first connecting portion 26*c*. The hollow cylindrical portion 26*d* has a length of, for example, 16 mm, which is defined in a longitudinal direction thereof. As is clearly shown in FIG. 1, the second terminal 26 is constructed, such that left and right edges of the hollow cylindrical portion 26*c* are respectively positioned more outward with respect to a direction parallel to the coaxial cable 22 than left and right edges of the opposed base portions 26*a*. The hollow cylindrical portion 26*c* has a through opening 26*e* which is substantially rectangular in shape. The through opening 26*e* has a width of 2 mm, which is defined in a longitudinal direction of the hollow cylindrical portion 26*c*, and a length of 4.5 mm, which is defined in a circumferential direction of the hollow cylindrical portion 26*c*. The hollow cylindrical portion 26*c* is shaped so as to define a mouth portion 26*f*. The hollow cylindrical portion 26*c* is made resilient and sized so as to tightly hold the outer conductor 22*b* of the coaxial cable 22. That is, upon thrusting the coaxial cable 22 into the hollow cylindrical portion 26*c*, the mouth portion 26*f* is expanded so as to allow the coaxial cable 22 to be tightly held by the hollow cylindrical portion 26*c*.

Assembly of the connecting structure according to the present invention will be described in the following.

First, the first terminal 24 is soldered to the first feeding point 18 connected to the primary antenna 14. Then, the coaxial cable 22 is thrust into the hollow cylindrical portion 26*c* of the second terminal 26. With this, the mouth portion 26*f* is expanded, and the outer cover 22*d* of the coaxial cable 22 is tightly held by the hollow cylindrical portion 26*c*. Before thrusting of the coaxial cable 22, the outer conductor 22*b* is previously coated with a solder by, for example, a dip coating method. After the thrusting, solder is poured into the through opening 26*e* of the second terminal 26. During this pouring, the contact between the outer conductor 22*b* and the hollow cylindrical portion 26*c* is kept checked through the opening 26*e* with the naked eye. After confirming a sufficient contact therebetween, the pouring of the solder is stopped. Then, the second terminal 26 is placed on the second feed point 20. With this, an end portion of the inner conductor 22*a* of the coaxial cable 22 is placed on the supporting portion 24*b* of the first terminal 24. Then, the second terminal 26 is soldered at the opposed base portions 26*a* to the second feed point 20, and the inner conductor 22*a* is soldered to the supporting portion 24*b*.

The advantage of the present invention is that soldering between the outer conductor 22*b* and the hollow cylindrical portion 26*c* is assuredly achieved with an appropriate soldering time because the contact between the outer conductor 22*b* and the hollow cylindrical portion 26*c* is kept checked with the naked eye through the opening 26*e* during the pouring of the solder. Thus, according to the present invention, the soldering time does not become too long nor too short.

In the above-mentioned assembly, the first terminal 24 is soldered to the first feed point 18 before connecting the coaxial cable 22 with the first terminal 24. However, if desired, the coaxial cable 22 may be connected to the first and second terminals 24 and 26, and then the terminals 24 and 26 can be respectively soldered to the first and second feed points 18 and 20.

According to the present invention, if desired, the first terminal 24 may be omitted, and the inner conductor 22*a* of the coaxial cable 22 may be directly soldered to the first feed point 18.

In the above-mentioned assembly, the outer conductor 22*b* of the coaxial cable 22 is previously coated with solder before thrusting the coaxial cable 22 into the hollow cylindrical portion 26*c*. However, if desired, the coating may be omitted. In this case, the outer conductor 22*b* is soldered to the hollow cylindrical portion 26*c* only by the solder poured into the through opening 26*e*.

Figure 3:
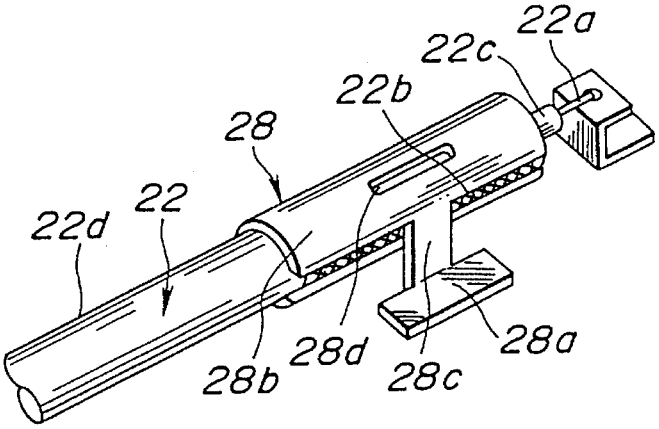
FIGS. 3 to 6 are views similar to FIG. 2, but showing connecting structures according to second to fifth embodiments of the present invention.

With reference to FIG. 3, a connection structure according to a second embodiment of the present invention will be described in the following. The first embodiment is modified with respect to the second terminal.

A second terminal 28 according to the second embodiment comprises a rectangular base portion 28*a*, a hollow cylindrical portion 28*b* and a connecting portion 28*c*. The cylindrical portion 28*b* has a through opening 28*d* which is substantially rectangular in shape. The through opening 28*d* has a width of 2 mm, which is defined in a circumferential direction of the cylindrical portion 28*b*, and a length of 4 mm, which is defined in a longitudinal direction of the same.

Figure 4:
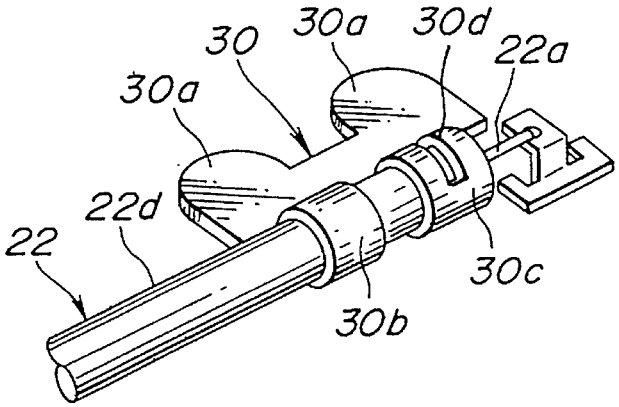

With reference to FIG. 4, a connection structure according to a third embodiment of the present invention will be described in the following. The first embodiment is modified with respect to the second terminal.

A second terminal 30 according to the third embodiment comprises opposed base portions 30*a*, a larger cylindrical portion 30*b* for holding the outer cover 22*d* of the coaxial cable 22, and a smaller cylindrical portion 30*c* for holding the outer conductor 22*b* of the same. The smaller cylindrical portion 30*c* has a through opening 30*d* which is substantially rectangular in shape. The through opening 30*d* has a width of 2 mm, which is defined in a longitudinal direction of the smaller cylindrical portion 30*c* and a length of 4.5 mm, which is defined in a circumferential direction of the same.

Figure 5:
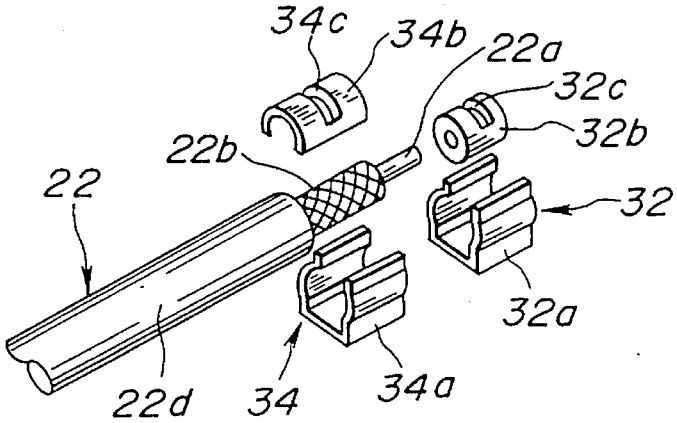

With reference to FIG. 5, a connection structure according to a fourth embodiment of the present invention will be described in the following. The first embodiment is modified with respect to the first and second terminals.

A first terminal 32 according to the fourth embodiment comprises a base holding portion 32*a*, and a holding portion 32*b* for receiving therein the inner conductor 22*a* of the coaxial cable 22. The holding portion 32*b* has a first through opening 32*c* which is substantially rectangular in shape. The first through opening 32*c* has a width of 2 mm which is defined in a longitudinal direction of the hollow cylindrical portion 32*b*, and a length of 4.0 mm, which is defined in a circumferential direction of the holding portion 32*b*. A second terminal 34 according to the fourth embodiment comprises a base portion 34*a*, and a holding portion 34*b* for holding the outer conductor 22*b* of the coaxial cable 22. The holding portion 34*b* has a second through opening 34*c* which is substantially rectangular in shape. The second through opening 34*c* has a width of 2 mm which is defined in a longitudinal direction of the semicylindrical portion 34*b*, and a length of 4.0 mm, which is defined in a circumferential direction of the holding portion 34*b*. In assembly, firstly, the coaxial cable 22 is thrust into the semicylindrical portion 34*b* and the holding portion 32*b*. Then, solder is poured into the first and second through openings 32*c* and 34*c* under the condition that the contact between the outer conductor 22*b* and the holding portion 34*b* and the contact between the inner conductor 22*a* and the holding portion 32*b* are checked with the naked eye so as to achieve adequate solderings therebetween. Then, the holding portion 34*b* and the holding portion 32*b* are respectively brought into engagement with the base portions 34*a* and 32*a* in a snap action manner.

Figure 6:
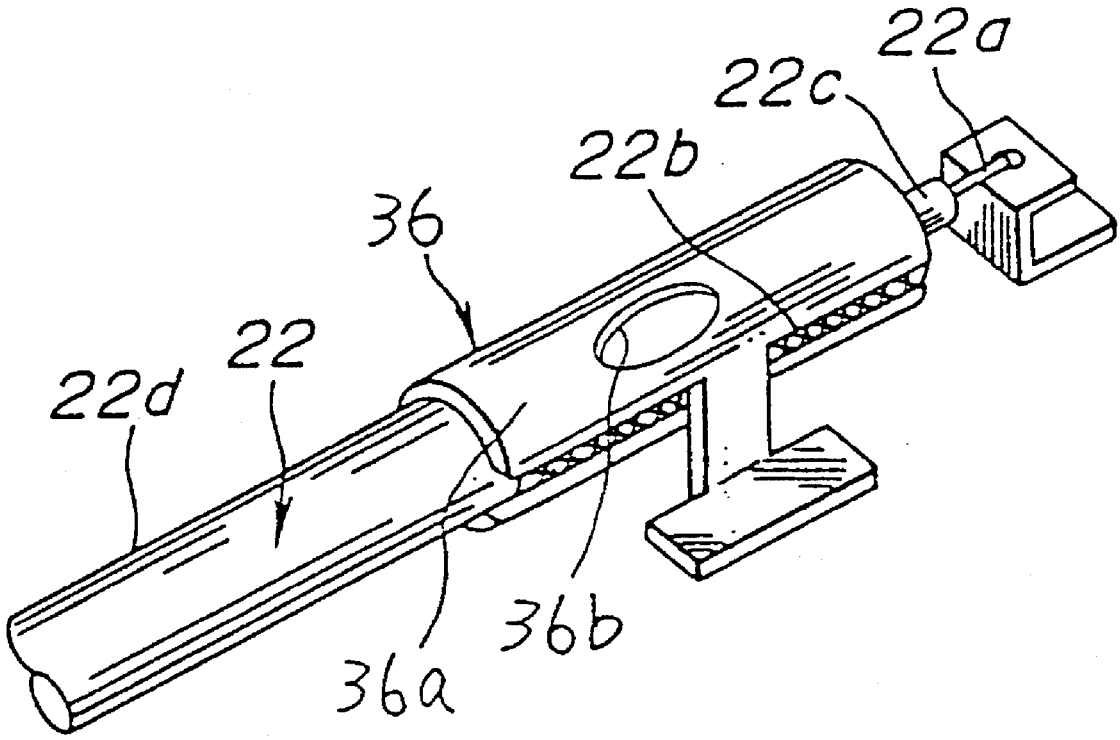

With reference to FIG. 6, a connection structure according to a fifth embodiment of the present invention will be described in the following. In this embodiment, the second embodiment is modified with respect to only the through opening of the second terminal.

A second terminal 36 according to the fifth embodiment has a hollow cylindrical portion 36*a*. The cylindrical portion 36*a* has a through opening 36*b* which is substantially elliptical in shape. The through opening 36*b* has a minor axis having a length of 2 mm, which is defined in a circumferential direction of the cylindrical portion 36*a*, and a major axis having a length of 4 mm, which is defined in a longitudinal direction of the same.

In a comparison between the second terminals 26, 28, 30, 34 and 36, the second terminals 26, 28, 30 and 36 are better than the second terminal 34 in workability because the second terminals 26, 28, 30 and 36 are monolithic in construction.

According to the preferred embodiments of the present invention, it is preferable that the through opening of the second terminal, which is substantially rectangular in shape, has a width ranging from 1.5 mm to 2.5 mm and a length ranging from 4 mm to 6 mm. According to another preferred embodiment of the present invention, it is preferable that the through opening of the second terminal, which is substantially elliptical in shape, has a minor axis of which length ranges from 1.5 mm to 2.5 mm and a major axis of which length ranges from 4 mm to 6 mm. If the size of the through opening is too large, the second terminal becomes insufficient in mechanical strength. If the size of the through opening is too small, it becomes difficult to check the contact between the outer conductor 22*b* and the hollow cylindrical portions 26*c*, 28*b*, 30*c* or 36*a* or the semicylindrical portion 34*b* with the naked eye during the pouring of the solder.

In a comparison between the second terminals 26, 28, 30 and 36, the second terminals 26 and 30 are better than the second terminals 28 and 36 in mechanical strength because the second terminals 26 and 30 are respectively provided with two opposed base portions 26*a* and 30*a*.

What is claimed is:

1. An antenna attached to a window glass for transmitting and receiving ultrashort waves, the antenna comprising:

a primary antenna having a first feed point which is electrically connected therewith;

a secondary antenna having a second feed point which is electrically connected therewith;

a feeder which is a coaxial cable having inner and outer conductors, an insulator disposed therebetween, and an outer cover covering the outer conductor, said inner conductor being electrically connected with said first feed point; and a terminal which is electrically connected with said second feed point, said terminal having a holding portion for holding the outer conductor of said feeder, said holding portion having a first portion and a through opening which is elongate in shape for pouring thereinto a solder to achieve a soldering between said outer conductor and said holding portion, said through opening having a major side having a length not shorter than 4 mm, said through opening having a periphery which is substantially completely surrounded by said first portion.

2. An antenna according to claim 1, wherein said through opening is substantially rectangular in shape.

3. An antenna according to claim 1, wherein said holding portion of said terminal is hollow and substantially cylindrical in shape and has means for defining a mouth portion, the mouth portion being expanded, upon thrusting said outer conductor into said holding portion, such that the outer conductor is tightly held by said holding portion.

4. An antenna according to claim 1, wherein said holding portion of said terminal is hollow and substantially semicylindrical in shape.

5. An antenna according to claim 1, wherein said terminal has another holding portion for holding said outer cover of said feeder so as to tightly hold said feeder.

6. An antenna according to claim 1, wherein said through opening has a major side having a length ranging from 4 mm to 6 mm and a minor side having a length ranging from 1.5 mm to 2.5 mm.

7. An antenna according to claim 1, further comprising another terminal which is electrically connected to said first feed point, said another terminal has a holding portion for holding said inner conductor of said feeder so as to achieve an electrical connection between said another terminal and said inner conductor.

8. An antenna according to claim 1, wherein said terminal has a base portion which is electrically connected to said second feed point.

9. An antenna according to claim 8, wherein said base portion comprises first and second opposed portions and a connecting portion for connecting said first and second opposed portions with each other.

10. An antenna according to claim 8, wherein said base portion is rectangular in shape.

11. An antenna attached to a window glass for transmitting and receiving ultrashort waves, the antenna comprising:

a primary antenna having a first feed point which is electrically connected therewith;

a secondary antenna having a second feed point which is electrically connected therewith;

a feeder which is a coaxial cable having inner and outer conductors, an insulator disposed therebetween, and an outer cover covering the outer conductor, said inner conductor being electrically connected with said first feed point;

a terminal which is electrically connected with said second feed point, said terminal has a base portion which is electrically connected to said second feed point and said terminal having a holding portion for holding the outer conductor of said feeder, said holding portion having a through opening which is elongate in shape for pouring thereinto a solder to achieve a soldering between said outer conductor and said holding portion, said through opening having a major side having a length not shorter than 4 mm; and wherein said base portion comprises first and second opposed resilient portions for receiving therebetween said holding portion in a snap action manner.

12. An antenna attached to a window glass for transmitting and receiving ultrashort waves, the antenna comprising:

a primary antenna having a first feed point which is electrically connected therewith;

a secondary antenna having a second feed point which is electrically connected therewith;

a feeder which is a coaxial cable having inner and outer conductors, an insulator disposed therebetween, and an outer cover covering the outer conductor, said inner conductor being electrically connected with said first feed point; and a terminal which is electrically connected with said second feed point, said terminal having a holding portion for holding the outer conductor of said feeder, said holding portion having a first portion and a through opening which is substantially elliptical in shape for pouring thereinto a solder to achieve a soldering between said outer conductor and said holding portion, said through opening having a major axis having a length not shorter than 4 mm, said through opening having a periphery which is substantially completely surrounded by said first portion.

13. An antenna according to claim 1, wherein said through opening has a major axis having a length ranging from 4 mm to 6 mm and a minor axis having a length ranging from 1.5 mm to 2.5 mm.

* * * * *